United States Patent [19]

Francis

[11] Patent Number: 4,868,983

[45] Date of Patent: Sep. 26, 1989

[54] SAFETY RAZOR WITH PLURAL ADJUSTABLE BLADES

[75] Inventor: John F. Francis, Woking, England

[73] Assignee: The Gillette Company, Boston, Mass.

[21] Appl. No.: 299,810

[22] PCT Filed: Apr. 19, 1988

[86] PCT No.: PCT/US88/01310

§ 371 Date: Dec. 28, 1988

§ 102(e) Date: Dec. 28, 1988

[87] PCT Pub. No.: WO88/09710

PCT Pub. Date: Dec. 15, 1988

[30] Foreign Application Priority Data

Jun. 1, 1987 [GB] United Kingdom ..... 8712785

[51] Int. Cl.[4] ..... B26B 21/22

[52] U.S. Cl. ..... 30/50; 30/47

[58] Field of Search ..... 30/47–50, 30/51, 32, 346.5, 346.58, 346.59

[56] References Cited

U.S. PATENT DOCUMENTS

| | | | |
|---|---|---|---|
| 4,270,268 | 6/1981 | Jacobson | 30/47 |
| 4,302,876 | 12/1981 | Emmett | 30/47 |
| 4,378,633 | 6/1981 | Jacobson | 30/50 X |
| 4,403,412 | 9/1983 | Trotta | 30/50 |
| 4,516,321 | 5/1985 | Francis | 30/47 |

*Primary Examiner*—Douglas D. Watts

*Attorney, Agent, or Firm*—Ladas & Parry

[57] ABSTRACT

A pair of compact blade units are connected together at each end by a spring metal link comprising independent spring fingers 2, a lug 7 having inner guide surfaces 8 and an end wall 3 with an aperture providing outer guide edges 9, and a top wall 6. Blade support members are guided vertically by co-operating pairs of guide edges 8, 9 and spring loaded upwardly by the respective spring fingers 2.

8 Claims, 3 Drawing Sheets

SAFETY RAZOR WITH PLURAL ADJUSTABLE BLADES

This invention relates to blade units for safety razors and more specifically to blade units of the general form described in British Patent specification Nos. 1487834 and 2064410B, respectively.

The units described in those specifications each comprise a narrow, elongate blade strip sharpened along one longitudinal edge and an elongate metallic support member presenting over a length at least equal to the length of the blade strip a surface of lesser width than the blade strip to which one face of the blade strip is directly attached, with the cutting edge of the strip projecting forwardly of the support and with the end portions of the support projecting beyond the ends of the blade strip. Blade units of this general form are hereinafter referred to as "compact blade units".

In GB No. 1487834 the support is of generally wire-like form and in GB No. 2064410B, the support is of angular cross-section, having a narrow flange to which the blade strip is attached and a depending leg.

The above described compact blade units are so styled because they may be given a very small width and depth to advantage with respect both to manufacturing costs and the compactness of the razor heads in which they are employed. They do, however, due to their very compactness, present problems in handling during manufacture, and in assembly of razor heads or cartridges, as well as in packaging and dispensing when designed as exchangeable head units.

A solution to this problem, with particular respect to the compact blade units in the form in which the blade support is of wire-like form, is proposed in British Patent Specification No. 2131337B in which a pair of blade units have a pair of links moulded directly onto the adjacent end portions of the supports to form a permanent integrated assembly in which the two blade strips are held in spaced parallel relation, so as to constitute a tandem blade unit.

The moulded links may be of elastomeric material so as to provide a degree of independent sprung suspension for the blade units.

In accordance with a feature of the present invention, a pair of compact blade units are connected together at their respective ends by a pair of links each of spring sheet metal, each link being of integral form shaped to provide:

guide surfaces for lateral location of the respective blade supports to maintain their spacing, the surfaces permitting limited movement of the blade supports therealong in directions transverse to a notional plane containing the cutting edges of the blade strips; and a pair of independent spring fingers bearing upwardly on the respective supports to bias them upwardly along the guide surfaces, the links cooperating with the blade units to retain the links longitudinally with respect to the blade units. Thus, the links not only perform the functions of the elastomeric links described in GB No. 2131337, they also provide for positive guidance of the blade units in their relative movement and the springs are able to act totally independently of each other. This cannot, of course, be achieved with integral elastomeric links because of the tendency of elastomers to transmit forces and strains throughout their masses. Furthermore, the degree of springing provided by metallic spring fingers is much more readily controllable in design and manufacture.

Tandem blade units in accordance with the invention may be incorporated permanently in disposable razors, or in exchangeable blade cartridges or may simply constitute exchangeable blade units in themselves.

Some embodiments of the invention will now be described, by way of example, with reference to the accompanying drawings, in which:

FIG. 1 is a plan view of a link as partially formed;

FIG. 2, 3, and 4A are a side view, end view and perspective view, respectively of a fully formed link;

Figure 1:
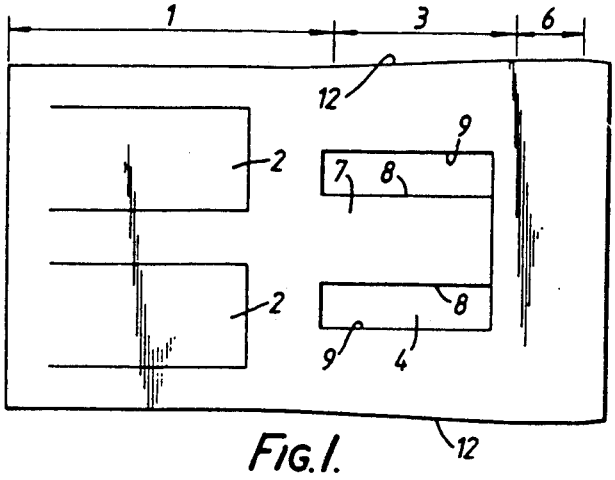
Figure 2:
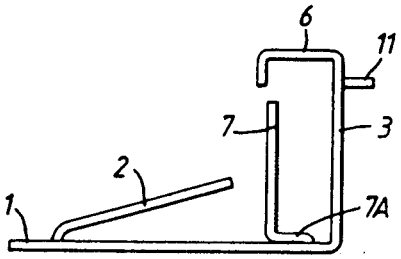
Figure 3:
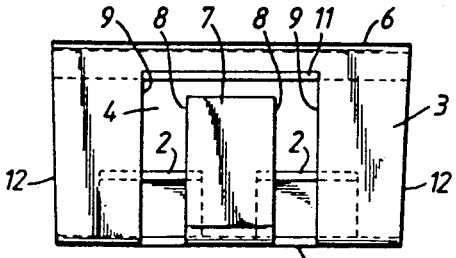

FIG. 1 shows a partially formed blank of spring quality brass sheet. It comprises: a base portion 1 out of which are struck two spring fingers 2; an end wall portion 3 having two pierced rectangular apertures 4, a top wall portion 6; and a lug 7 whose longitudinal side edges are destined to form inner guide surfaces 8. Those side edges of apertures 4 which are parallel with the lug are destined to form outer guide surfaces 9. The blank is then folded into the form best seen in FIG. 3, in which the base portion 1 is assumed to be horizontal, the end wall portion 3 and lug 7 vertical and the top wall portion 6 horizontal. At its base, the lug 7 is folded back over the base portion 1 to form a ledge 7A. Also, a narrow flange 11 is struck out of the upper edge of the aperture 4. The side edges 12 of end wall portion 3 are slightly divergent upwardly, to facilitate mounting of the link in a plastics holder, to be described below.

Figure 5:
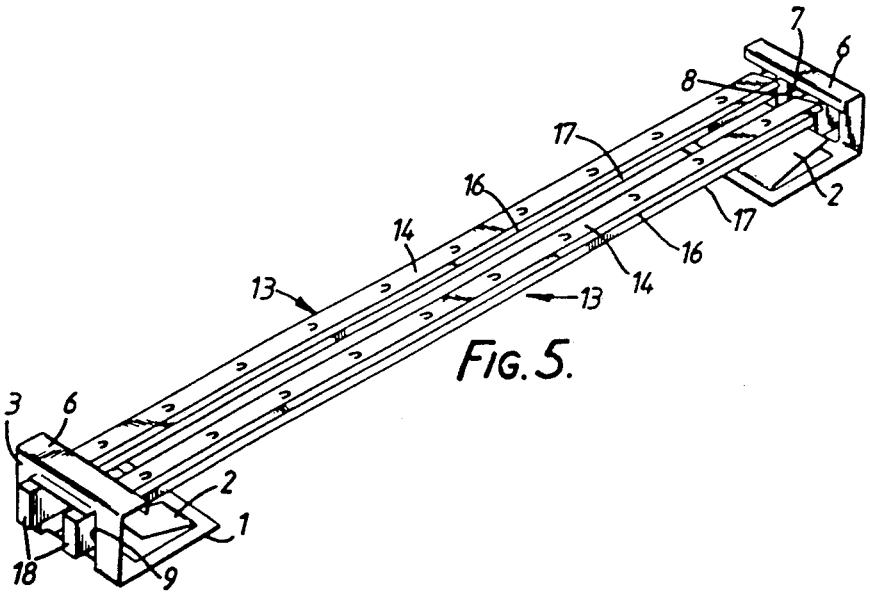
FIG. 5 is a perspective view of a tandem blade assembly using the links of FIGS. 2 to 4A.
Figure 6:
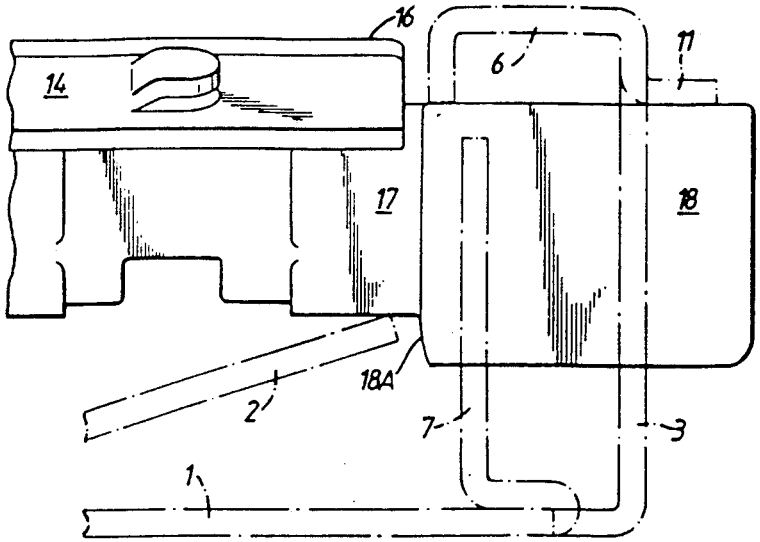
FIG. 6 is an enlarged scrap view of part of the assembly of FIG. 5.

FIG. 5 shows a tandem blade assembly incorporating a pair of links described above and two compact blade units 13. Each unit 13 comprises a narrow blade strip 14 sharpened along one edge 16, and directly attached to a support 17 of soft galvanized wire having projecting end portions 18 pressed into a rectangular cross section. FIG. 6 is a greatly enlarged scrap side view of the end portion of one blade unit, showing the assembled position of the link in phantom line. The end portions 18 pass to either side of the lug 7 and through the rectangular aperture 4, and the spring fingers 2 bear upwardly on the support 17 adjacent end portions 18, which present inwardly facing shoulders 18A which obstruct longitudinal disengagement of the link from the blade units.

Inward displacement is obstructed by abutment of the end edges of the blade strips with the flanged inner edge of the top wall 6. The end portions 18 are guided for limited vertical movement by the guide surfaces 8 and 9.

It will be appreciated that the links are readily assembled to the blade units by a simple longitudinal relative movement, the spring fingers 2 being deflected downwardly as they pass beneath the end portions 18 and then springing back as they pass shoulder 18A.

Figure 7:
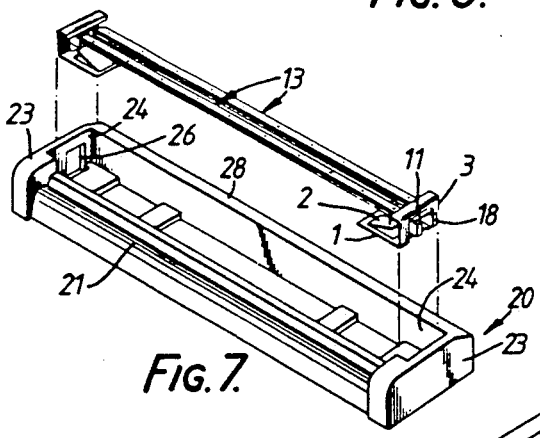
FIG. 7 is an exploded perspective view illustrating incorporation of the above tandem blade assembly with a moulded razor cartridge.

FIG. 7 is an exploded perspective view illustrating assembly of the tandem blade unit with a razor cartridge moulding 20, of open-topped box-like form. It has a front wall forming a skin guard 21, a rear wall forming a skin-engaging cap 22 and opposite end walls 23 formed with pockets 24 to receive the links and recesses 26 whose upper edges capture the link flanges 11.

The tandem blade assembly is simply pressed down into the moulding 20, the links deflecting resiliently to permit the flanges 11 to snap into the recesses 26 to secure the assembly.

The moulding 20 is illustrated as forming an exchangeable cartridge, but if integrated with a handle it would form the head of a disposable razor.

The tandem blade units may also constitute replaceable units in themselves, for use with razors whose heads are designed to releasably retain the blade units. In that case, the step 7A at the base of lug 7 may be engageable by displaceable latches forming part of the razor head. A number of such blade units may readily be stacked vertically, and/or laterally in a suitable dispensing container or magazine, particularly since the links of adjacent units can directly abut each other without the blade edges contacting any portions of the adjacent units.

Figure 4A:
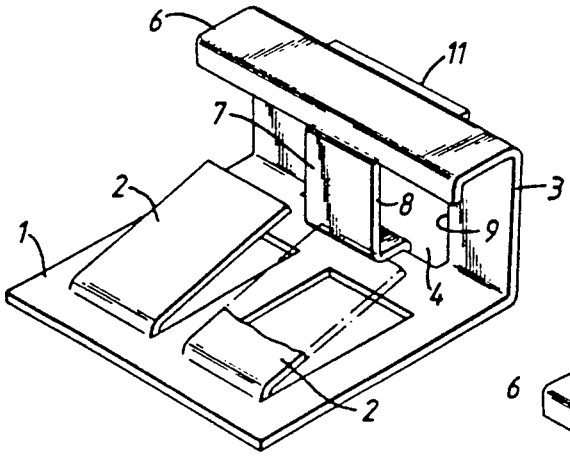
FIG. 4B is a perspective view of a modified form of link.
Figure 4B:
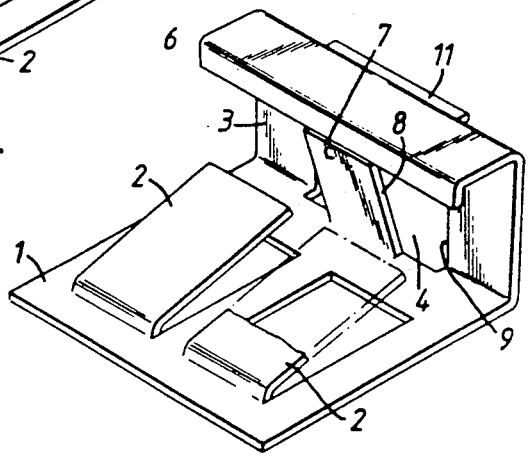

FIG. 4B illustrates a modified link in which the lug 7 is simply angled upwardly and inwardly from its root at the outer edge of the base portion 1. This simpler construction may be preferred for units which are to be permanently mounted in a cartridge or razor head.

Figure 8:
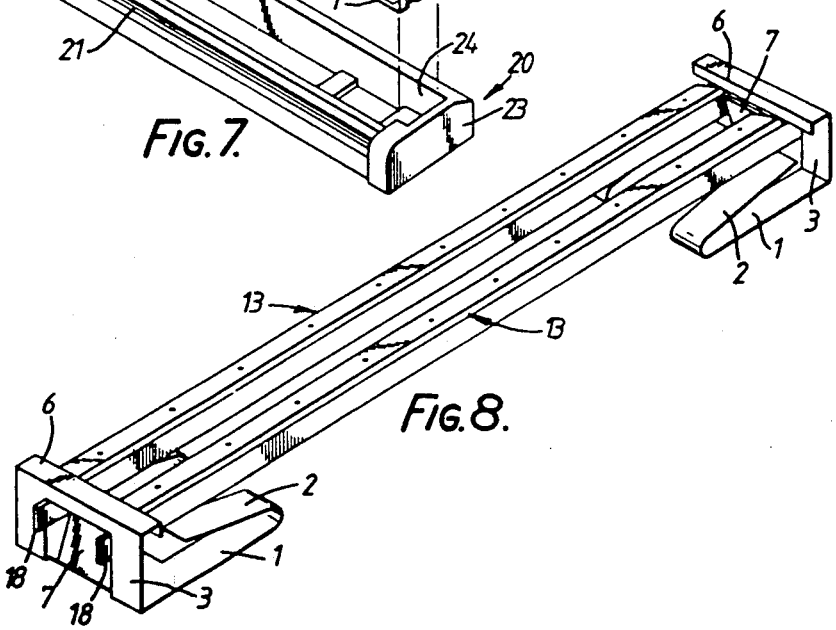
FIG. 8 is a view corresponding to FIG. 5 of a modified embodiment of the invention.

FIG. 8 illustrates a tandem blade unit embodying the links of FIG. 4B and in which the individual blade units are of the general form described and illustrated in British Patent Specification 2064410, in which the projecting end portions are formed as extensions of the vertical leg (or base portions) of the blade support.

In each of the above described embodiments, the blade units are guided for vertical movement, i.e. movement perpendicular to a notional plane containing the blade edges 16. The blade strips 14 are each set at an angle to that notional plane, this angle being $22\frac{1}{2}°$ in the particular cases described.

Many variations and modifications will, of course, be possible within the scope of the invention. For example, the blade units could be mounted with their cutting edges directed towards each other rather than being in tandem.

Also, the links could if desired be interconnected for ease of handling and eventual assembly into a razor head or cartridge. They may, for example have their base portions interconnected by one or more bar-like elongate elements which may be formed integrally with the links or separately formed and subsequently secured to them.

I claim:

1. A tandem blade assembly for a safety razor, comprising a pair of compact blade units, each having a blade strip and a blade support, said blade unit being connected together at their respective ends by a pair of links, each link being of integral form shaped to provide:

guide surfaces for lateral location of the respective blade supports to maintain their spacing, the surfaces permitting limited movement of the blade supports therealong in directions transverse to a notional plane containing the cutting edges of the blade strips; and a pair of independent spring fingers bearing upwardly on the respective supports to bias them upwardly along the guide surfaces, the links co-operating with the blade units to retain the links longitudinally with respect to the blade units.

2. An assembly according to claim 1, wherein each link comprises a horizontal base portion and a transverse end wall upstanding therefrom, the end wall having an aperture whose vertical side edges constitute the outer guide surfaces, and an upwardly extending lug whose side edges are spaced inwardly from the said side edges and constitute the inner guide surfaces.

3. An assembly according to claim 2, wherein the base portion has two separate, cantilever spring fingers struck out of it, the fingers being joined at their roots to the base portion and sloping upwardly and outwardly towards the end wall of the link.

4. An assembly according to claim 3, wherein the free, upper ends of the spring fingers engage under the respective blade units, each of which has an inwardly facing shoulder positioned beyond the end of the respective finger and is engageable therewith to limit longitudinal inward movement of the link, relative to the blade units.

5. An assembly according to claim 2, wherein the blade strip of each blade unit projects forwardly and upwardly from its support and the end wall of each link. carries an inwardly projecting top wall which acts as an abutment for engaging the end edges of the blade strips to limit displacement of the links inwardly of the blade units.

6. An assembly according to claim 2, wherein the base of the lug is doubled back over the base portion to present an outwardly directed ledge.

7. An assembly according to claim 2, wherein the lugs extends upwardly and inwardly from the outer edge of the base portion of the link.

8. An assembly according to claim 1, wherein the said links are interconnected by one or more elongate elements.

* * * * *